US008609209B2

(12) United States Patent
Taguri et al.

(10) Patent No.: US 8,609,209 B2
(45) Date of Patent: Dec. 17, 2013

(54) INK JET RECORDING MEDIUM

(75) Inventors: Ryo Taguri, Sagamihara (JP); Hisao Kamo, Ushiku (JP); Yasuhiro Nito, Yokohama (JP); Tetsuro Noguchi, Hachioji (JP); Isamu Oguri, Yokohama (JP); Olivia Herlambang, Kawasaki (JP); Naoya Hatta, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 13/249,924

(22) Filed: Sep. 30, 2011

(65) Prior Publication Data

US 2012/0094039 A1 Apr. 19, 2012

(30) Foreign Application Priority Data

Oct. 18, 2010 (JP) ..... 2010-233580

(51) Int. Cl.
*B41M 5/00* (2006.01)
*B41M 5/52* (2006.01)
*B41M 5/50* (2006.01)

(52) U.S. Cl.
CPC ..... *B41M 5/5218* (2013.01); *B41M 5/52* (2013.01); *B41M 5/506* (2013.01); *B41M 5/5254* (2013.01)
USPC ..... 428/32.21; 428/32.24; 428/32.25; 428/32.26; 428/32.28; 428/32.32

(58) Field of Classification Search
CPC ..... B41M 5/5218; B41M 5/52; B41M 5/506; B41M 5/5254
USPC ..... 428/32.21, 32.24, 32.25, 32.26, 32.28, 428/32.32
See application file for complete search history.

(56) References Cited

U.S. PATENT DOCUMENTS

| | | | |
|---|---|---|---|
| 6,562,441 | B1 | 5/2003 | Maeda et al. |
| 6,874,881 | B2 | 4/2005 | Suzuki et al. |
| 6,929,362 | B2 | 8/2005 | Takada et al. |
| 6,932,465 | B2 | 8/2005 | Nito et al. |
| 6,935,732 | B2 | 8/2005 | Takada et al. |
| 7,029,109 | B2 | 4/2006 | Shirota et al. |
| 7,055,943 | B2 | 6/2006 | Suzuki et al. |
| 7,208,032 | B2 | 4/2007 | Hakamada et al. |
| 7,276,110 | B2 | 10/2007 | Tsujimura et al. |
| 7,276,112 | B2 | 10/2007 | Tokuda et al. |
| 7,347,890 | B2 | 3/2008 | Nito et al. |
| 7,354,145 | B2 | 4/2008 | Nito et al. |
| 7,377,631 | B2 | 5/2008 | Takada et al. |
| 7,402,200 | B2 | 7/2008 | Imai et al. |
| 7,517,073 | B2 | 4/2009 | Nito et al. |
| 7,517,074 | B2 | 4/2009 | Hakamada et al. |
| 7,537,329 | B2 | 5/2009 | Nito et al. |
| 7,625,614 | B2 | 12/2009 | Kamo et al. |
| 7,635,182 | B2 | 12/2009 | Hakamada et al. |
| 7,846,516 | B2 | 12/2010 | Kamo et al. |
| 7,867,586 | B2 | 1/2011 | Kamo et al. |
| 8,016,406 | B2 | 9/2011 | Hakamada et al. |
| 2003/0039808 | A1 | 2/2003 | Ichinose et al. |
| 2006/0172093 | A1* | 8/2006 | Watanabe et al. ..... 428/32.24 |
| 2008/0152827 | A1 | 6/2008 | Hakamada et al. |
| 2009/0109270 | A1 | 4/2009 | Kobayashi |
| 2009/0142519 | A1 | 6/2009 | Nagai et al. |
| 2010/0310795 | A1* | 12/2010 | Tanaka et al. ..... 428/32.1 |
| 2011/0008553 | A1 | 1/2011 | Hyakuda et al. |
| 2011/0076427 | A1 | 3/2011 | Hyakuda et al. |
| 2011/0104411 | A1 | 5/2011 | Oguri et al. |
| 2011/0135855 | A1 | 6/2011 | Oguri et al. |
| 2011/0293860 | A1 | 12/2011 | Oguri et al. |

FOREIGN PATENT DOCUMENTS

| | | | |
|---|---|---|---|
| DE | 11 2004 001 339 | B4 | 6/2009 |
| EP | 1 016 542 | A1 | 7/2000 |
| EP | 1 101 624 | A2 | 5/2001 |
| JP | 2002-225424 | A | 8/2002 |
| WO | 2007/043713 | A1 | 4/2007 |

OTHER PUBLICATIONS

Feb. 9, 2012 European Search Report in European Patent Appln. No. 11008025.6.

* cited by examiner

*Primary Examiner* — Betelhem Shewareged
(74) *Attorney, Agent, or Firm* — Fitzpatrick, Cella, Harper & Scinto

(57) ABSTRACT

An ink jet recording medium including a substrate and an ink receiving layer provided on the substrate and composed of two or more layers of at least an upper layer and a lower layer. The ink receiving layer contains polyvinyl alcohol in an amount of 12.7% by mass or more based on the total mass of the ink receiving layer. The upper layer is a layer most distant from the substrate, contains a pigment and polyvinyl alcohol, the pigment containing 90% by mass or more of alumina hydrate, and has a thickness of 3.0-10.0 μm. The lower layer is positioned just under the upper layer, contains a pigment and polyvinyl alcohol, the pigment containing 20% by mass or more of silica, and has a thickness 2.5-10 times larger than that of the upper layer and an average pore radius 0.90-1.30 times larger than that of the upper layer.

17 Claims, No Drawings

INK JET RECORDING MEDIUM

BACKGROUND OF THE INVENTION

1. Field of the Invention

The present invention relates to an ink jet recording medium

2. Description of the Related Art

A recording medium having an ink receiving layer on a substrate is known as a recording medium on which recording is conducted by an ink jet recording apparatus. The ink receiving layer is required to rapidly absorb ink. Occurrence of color unevenness on an image can be inhibited by rapidly absorbing ink. As such an ink jet recording medium, there is a recording medium described in International Publication No. WO2007/043713. The recording medium described in International Publication No. WO2007/043713 is such that the ink receiving layer on the substrate has a lower layer and an upper layer, and the thickness ratio of the lower layer to the upper layer and the weight ratio of alumina used in the upper and lower layers are controlled to improve ink absorbency.

In recent years, the ink jet recording medium has been required to have high-speed printability, and so there has been need to improve the conveying accuracy of the recording medium by holding the recording medium between conveying rollers to convey the recording medium. In order to improve the conveying accuracy, it is favorable to use hard conveying rollers hard to be deformed even when the recording medium is held. When such hard conveying rollers are used for the recording medium, however, roller mark of the conveying roller is liable to be left on the recording medium. The roller mark is entirely different in appearance from common scratch defects or flaws caused by applying a load like a pencil hardness test and is an aggregate of minute dimples of 0.1 μm to 5.0 μm in diameter and 0.1 μm to 5.0 μm in depth. The roller mark is considered to be a transfer mark caused when plastic deformation is caused on a conveying roller during printing and then the conveying roller on the surface of which minute projections are thus produced comes into contact with the surface of the recording medium. In the recording medium described in International Publication No. WO2007/043713, such roller mark as described above has been caused in some cases when high-speed printing has been conducted thereon by means of an ink jet recording apparatus.

In addition, in the recording medium described in International Publication No. WO2007/043713, color unevenness has been caused on a resulting image in some cases when such high-speed printing as required in recent years has been conducted. The color unevenness is considered to be caused because ink absorption sufficient for the high-speed printing cannot be attained.

In view of the foregoing problems, it is an object of the present invention to provide an ink jet recording medium which inhibits the occurrence of roller marks and rapidly absorbs ink to inhibit the occurrence of color unevenness on an image even when high-speed printing is conducted by an ink jet recording apparatus.

SUMMARY OF THE INVENTION

The above object can be achieved by the present invention described below. The present invention thus provides an ink jet recording medium comprising a substrate and an ink receiving layer provided on the substrate and composed of two or more layers of at least an upper layer and a lower layer, wherein the ink receiving layer composed of the two or more layers contains polyvinyl alcohol in an amount of 12.7% by mass or more based on the total mass of the ink receiving layer composed of the two or more layers, the upper layer is a layer most distant from the substrate in the ink receiving layer composed of the two or more layers, contains a pigment and polyvinyl alcohol, the pigment containing 90% by mass or more of alumina hydrate, and has a layer thickness of 3.0 μm or more and 10.0 μm or less, and the lower layer is a layer just under the upper layer, contains a pigment and polyvinyl alcohol, the pigment containing 20% by mass or more of silica, and has a layer thickness 2.5 times or more and 10 times or less larger than that of the upper layer and an average pore radius 0.90 times or more and 1.30 times or less larger than that of the upper layer.

According to the present invention, there can be provided an ink jet recording medium which inhibits the occurrence of roller marks even when high-speed printing is conducted by an ink jet recording apparatus and rapidly absorbs ink, thereby inhibiting the occurrence of color unevenness.

Further features of the present invention will become apparent from the following description of exemplary embodiments.

DESCRIPTION OF THE EMBODIMENTS

Preferred embodiments of the present invention will now be described in detail.

As a method for inhibiting the occurrence of roller marks, it is considered that the surface strength of a recording medium is made higher than that of a conveying roller. The surface strength of a conveying roller with good conveying accuracy is of the order of from 10 $N/mm^2$ to 110 $N/mm^2$ in terms of Martens hardness, and when the Martens hardness of the surface of a recording medium is made high so as to be more close to 110 $N/mm^2$, the resistance to roller marks is more improved.

However, it has been confirmed that when the surface strength of the recording medium is made high, the ink receiving layer thereof becomes fragile, and the ink receiving layer cracks when the recording medium is conveyed, thereby lowering conveying accuracy. Taking the above circumstances into consideration, the surface strength of the recording medium is favorably 30 $N/mm^2$ or more and 90 $N/mm^2$ or less in terms of Martens hardness. The surface strength is more favorably 35 $N/mm^2$ or more and 65 $N/mm^2$ or less.

The present inventors have carried out a detailed investigation with a view toward inhibiting the roller mark and found that it is more effective than the control of the surface strength of the recording medium to apply to the recording medium elasticity sufficient for restoring dimples of the roller mark by the elasticity of the whole recording medium. Specifically, when measurement is conducted under conditions of an indentation load of 3 mN, an indentation time of 20 seconds and a creep time of 10 seconds by a hardness meter (trade name: PICODENTOR HM-50, manufactured by Fischer Instruments K.K.), the elastic deformation work rate is favorably 35% or more and 50% or less, more favorably 40% or more and 50% or less.

In order to achieve such an elastic deformation work rate as described above, it is necessary that the ink receiving layer has elasticity. Therefore, in the recording medium according to the present invention, the ink receiving layer is formed by two or more layers, and the ink receiving layer composed of the two or more layers contains polyvinyl alcohol in an amount of 12.7% by mass or more based on the total mass of the ink receiving layer composed of the two or more layers. Such an elastic deformation work rate as described above can be achieved by such a mixing amount. The upper limit of the content of polyvinyl alcohol is favorably 20.0% by mass or less. If the content is higher than this upper limit, the ink absorbency of the resulting ink receiving layer is lowered, and color unevenness may be caused on the resulting image in some cases. Examples of polyvinyl alcohol include common polyvinyl alcohol obtained by hydrolyzing polyvinyl acetate. The viscosity-average polymerization degree of polyvinyl alcohol is favorably 1,500 or more and 5,000 or less, more favorably 2,000 or more. The saponification degree of polyvinyl alcohol is favorably 80 or more and 100 or less, more favorably 85 or more.

The ink receiving layer composed of the two or more layers will now be described in detail. The ink jet recording medium according to the present invention has, on a substrate, an ink receiving layer composed of two or more layers of at least an upper layer and a lower layer.

First, the upper layer of the ink jet recording medium according to the present invention is described. The upper layer is a layer most distant from the substrate in the ink receiving layer composed of the two or more layers. In short, the upper layer is a layer which becomes an outermost layer of the recording medium. Incidentally, even when an extremely thin layer is provided on the upper layer (on a side distant from the substrate) within limits achieving the effect of the present invention, the upper layer is defined as the layer most distant from the substrate in the ink receiving layer composed of the two or more layers.

The upper layer contains a pigment and polyvinyl alcohol. The pigment in the upper layer contains 90% by mass or more of alumina hydrate. The upper layer contains the alumina hydrate in plenty as described above, whereby absorption of ink in the recording medium immediately after impact can be well attained, and occurrence of color unevenness on an image can be inhibited even when high-speed printing is conducted by an ink jet recording apparatus. The reason for this is that the alumina hydrate is high in surface energy compared with silica coated with a resin and can rapidly absorb ink immediately after impact. The pigment in the upper layer is favorably composed of the alumina hydrate alone. However, another pigment such as silica may be used in combination so far as the amount thereof is small.

The alumina hydrate favorably has a volume-average particle size of 1.0 mm or less. The alumina hydrate is represented by, for example, the following general formula (1):

$$Al_2O_{3-n}(OH)_{2n}.mH_2O \qquad \text{Formula (1)}$$

(in the formula, n is any one of 0, 1, 2 and 3, and m is a value falling within a range of from 0 to 10, favorably from 0 to 5. However, m and n are not 0 at the same time. In many cases, $mH_2O$ represents an aqueous phase which does not participate in the formation of a crystal lattice, but is eliminable, and so m may take an integer or a value other than integers. When this alumina hydrate is heated, m may reach a value of 0.).

The alumina hydrate can be prepared according to a general process. Examples of the process include a process of hydrolyzing an aluminum alkoxide and a process of hydrolyzing sodium aluminate. A process in which an aqueous solution of aluminum sulfate or aluminum chloride is added to an aqueous solution of sodium aluminate to conduct neutralization is also included. The alumina hydrate favorably exhibits a beohmite structure or amorphous structure when analyzed by X-ray diffractometry.

The polyvinyl alcohol contained in the upper layer is favorably such polyvinyl alcohol as described above. The content of the polyvinyl alcohol in the upper layer is favorably 5.0% by mass or more and 10.0% by mass or less, more favorably 6.4% by mass or more and 9.7% by mass or less, based on the total mass of the upper layer. If the content is less than 5.0% by mass, the surface strength of the resulting ink receiving layer may be lowered in some cases to cause cracks in the ink receiving layer. If the content exceeds 10% by mass, beading due to lowering of ink absorbency may occur, in particular, at a portion printed with a secondary or higher order color in some cases to lower image quality. In particular, the upper layer contains 90% by mass or more of alumina hydrate, so that the ink absorbency is liable to be markedly lowered if the content of polyvinyl alcohol is too increased. The reason for this is that the average pore radius of the alumina hydrate is smaller than that of silica having the same particle size, and so the pores are easily filled if the amount of polyvinyl alcohol is increased.

The average pore radius of the upper layer is favorably 8.00 nm or more and 11.30 nm or less. The average pore radius is controlled to 8.00 nm or more and 11.30 nm or less, whereby both ink absorbency and image quality can be well improved.

A sulfur-containing polymer compound is favorably used in combination in the upper layer. The combined use thereof can develop such effects that the fastness properties of a coloring material are improved, and the occurrences of bleeding and roller marks can be more effectively inhibited. Taking coloring positions of a coloring material into consideration, the sulfur-containing polymer compound is favorably incorporated in plenty into the upper layer from the viewpoint of the fastness properties of the coloring material. The favorable content of the sulfur-containing polymer compound in the upper layer is 0.1% by mass or more and 10.0% by mass or less based on the total mass of the upper layer. If the content is less than 0.1% by mass, the above effects cannot be sufficiently developed. If the content exceeds 10.0% by mass, the ink absorbency may be lowered in some cases. The content is more favorably 0.5% by mass or more and 6.0% by mass or less. When the sulfur-containing polymer compound is used in combination, the amount used is favorably 0.1% by mass or more and 15.0% by mass or less, more favorably 0.5% by mass or more and 14.0% by mass or less, in terms of the total amount of the compound and polyvinyl alcohol based on the amount of the alumina hydrate in the upper layer.

The layer thickness of the upper layer is 3.0 μm or more and 10.0 μm or less. If the layer thickness is less than 3.0 μm, the ink absorbency is lowered. If the layer thickness is larger than 10.0 μm, the resulting recording medium tends to cause roller marks. The reason for this is that the pigment contained in the upper layer is mainly alumina hydrate, and it is difficult to contain polyvinyl alcohol in plenty in the upper layer from the viewpoint of the ink absorbency as described above, so that the occurrence of roller marks cannot be inhibited if the layer thickness of the upper layer is too large. The layer thickness of the upper layer is favorably 5.0 μm or more and 8.0 μm or less. Incidentally, the layer thickness in the present invention is an absolute dry layer thickness. The layer thickness is a value determined by arbitrarily and evenly selecting 10 points on the ink receiving layer, measuring the layer thickness at each point through an electron microscope and averaging the measured values.

The lower layer of the ink jet recording medium according to the present invention is then described. The lower layer is a layer just under the upper layer. No layer is fundamentally provided between the upper layer and the lower layer. However, an extremely thin layer may be provided within limits achieving the effect of the present invention. Even in this case, the lower layer is defined as the layer just under the upper layer in the present invention.

The lower layer contains a pigment and polyvinyl alcohol. The pigment in the lower layer contains 20% by mass or more of silica. The pigment in the lower layer contains 20% by mass or more of silica as described above, whereby the content of polyvinyl alcohol in the lower layer can be increased, and so the lower layer can well absorb ink while inhibiting the occurrence of roller marks. The lower layer favorably contains silica in an amount of 50% by mass or more, more favorably 70% by mass or more, based on the total mass of the pigment contained in the lower layer.

The silica favorably has a volume-average particle size of 1.0 mm or less. Examples of the silica include colloidal silica and gas phase process silica. The silica favorably has a specific surface area of 100 $m^2/g$ or more and 400 $m^2/g$ or less, more favorably 200 $m^2/g$ or more and 350 $m^2/g$ or less. The pore volume of the silica is favorably 0.8 ml/g or more and 2.0 ml/g or less, more favorably 1.0 ml/g or more and 1.5 ml/g or less.

An aqueous medium for silica favorably contains a cationic polymer or water-soluble polyvalent metal compound and more favorably also contains a hardener. The cationic polymer is favorably a polymer having a quaternary ammonium salt group and is more favorably a homopolymer of a monomer having the quaternary ammonium salt group or a copolymer of this monomer and one or more copolymerizable monomers.

As another pigment than silica in the lower layer, for example, alumina hydrate is favorably used. As the alumina hydrate, may be used such alumina hydrate as described above. However, alumina hydrate having a smaller average pore radius than that of the alumina hydrate in the upper layer is favorable. When silica and alumina hydrate are mixed, haze occurs in the layer. However, since a portion colored with a coloring material component at a high concentration is about 10 μm distant from the surface of the ink receiving layer, the haze in the lower layer scarcely affects an image density and a color reproduction range. On the other hand, silica and alumina hydrate are mixed and dispersed, whereby dispersibility is more improved than the dispersion of silica alone, and handling ability during production is improved. Taking these into consideration, the content by mass of the silica is favorably one time or more and 19 times or less more than the content by mass of the alumina hydrate, and is more favorable 2 times or more and 4 times or less.

As the polyvinyl alcohol contained in the lower layer, may also be used such polyvinyl alcohol as described above. The kinds of polyvinyl alcohol used in the upper and lower layers may be the same or different from each other. The content of the polyvinyl alcohol in the lower layer is favorably 13.0% by mass or more and 20.0% by mass or less based on the total mass of the lower layer. The content of the polyvinyl alcohol is controlled to 13.0% by mass or more, whereby the occurrence of roller marks can be well inhibited. Since 20% by mass or more of silica is contained in the pigment of the lower layer, good ink absorbency can be developed even when the polyvinyl alcohol is contained in an amount as considerably large as 13.0% by mass or more. However, when the polyvinyl alcohol is contained in an amount exceeding 20.0% by mass, high-speed ink absorption may become difficult in some cases. The content of the polyvinyl alcohol is more favorably 13.5% by mass or more and 18.5% by mass or less.

Taking coloring positions of the coloring material into consideration, the sulfur-containing polymer compound is favorably incorporated in plenty into the upper layer as described above. However, the-sulfur-containing polymer compound may also be incorporated into the lower layer. The sulfur-containing polymer compound may be added within such a range that the total binder amount of the binder typified by the polyvinyl alcohol and the sulfur-containing polymer compound is 12.7% by mass or more and 16.9% by mass or less based on the total mass of the ink receiving layer. The favorable content of the sulfur-containing polymer compound in the lower layer is 0.1% by mass or more and 10.0% by mass or less based on the total mass of the lower layer. The content is more favorably 0.5% by mass or more and 2.5% by mass or less.

The average pore radius of the lower layer is 0.90 times or more and 1.30 times or less larger than that of the upper layer. If the average pore radius is 1.30 times or more larger, the diffusion rate of ink in the lower layer becomes too low compared with the diffusion rate of ink in the upper layer, so that such a phenomenon that the ink penetrated into the lowest portion of the upper layer begins to diffuse in a lateral direction of the upper layer before penetrating into the lower layer occurs to lower the ink absorbency. If the average pore radius is 0.90 times or less smaller, the amount of the binder that can be contained becomes small, so that the roller mark is liable to occur. The average pore radius of the lower layer is favorably 1.01 times or more and 1.26 times or less larger, more favorably 1.11 times or more and 1.26 times or less larger, than that of the upper layer. The average pore radius of the lower layer is favorably 10.55 nm or more and 12.80 nm or less, more favorably 12.33 nm or less. Incidentally, the average pore radius in the present invention is a value determined by the nitrogen adsorption/desorption method.

The layer thickness of the lower layer is 2.5 times or more and 10 times or less larger than that of the upper layer. Since 20% by mass or more of silica is contained in the pigment of the lower layer, polyvinyl alcohol can be contained in plenty. Accordingly, the layer thickness of such a lower layer is controlled to 2.5 times or more larger than that of the upper layer, whereby the elastic deformation work rate of the resulting recording medium can be raised to inhibit the occurrence of roller marks. On the other hand, the layer thickness is controlled to be 10 times or less larger, whereby the occurrence of cracks upon production can be inhibited. The layer thickness of the lower layer is favorably 3.8 times or more and 8.0 times or less larger than that of the upper layer. In short, in the present invention, the layer thickness of the lower layer is favorably 2.5 times or more and 8.0 times or less larger, more favorably 3.8 times or more and 8.0 times or less larger, than that of the upper layer. The layer thickness of the lower layer may be determined in connection with the upper layer as described above, but is favorably 15 μm or more and 30 μm or less.

In addition to the polyvinyl alcohol, another binder may be used in combination in the upper and lower layers. Such a binder is favorably a material that is capable of binding the pigments to form a film and does not impair the effect of the present invention. As examples thereof, may be mentioned the following binders: starch derivatives such as oxidized starch, etherified starch and phosphoric acid-esterified starch; cellulose derivatives such as carboxymethyl cellulose and hydroxyethyl cellulose; casein; gelatin; soybean protein; polyvinyl pyrrolidone; maleic anhydride resins; latexes of conjugated polymers such as styrene-butadiene copolymers and methyl methacrylate-butadiene copolymers; latexes of acrylic polymers such as acrylic ester and methacrylic ester polymers; latexes of vinyl polymers such as ethylene-vinyl acetate copolymers; functional-group-modified polymer latexes obtained by modifying the above-described polymers with a monomer containing a functional group such as a carboxyl group; cationized polymers obtained by cationizing the above-described polymers with a cationic group; cationized polymers obtained by cationizing the surfaces of the above-described polymers with a cationic surfactant; polymers on the surfaces of which polyvinyl alcohol has been distributed obtained by polymerizing the above-described polymers under cationic polyvinyl alcohol; polymers on the surfaces of which cationic colloid particles have been distributed obtained by polymerizing the above-described polymers in a suspended dispersion of the cationic colloid particles; aqueous binders such as thermosetting synthetic resins such as melamine resins and urea resins; polymer or copolymer resins of acrylic esters and methacrylic esters, such as polymethyl methacrylate; and synthetic resin binders such as polyurethane resins, unsaturated polyester resins, vinyl chloride-vinyl acetate copolymers, polyvinyl butyral and alkyd resins. These binders may be used either singly or in any combination thereof.

The upper and lower layers favorably contain a crosslinking agent. When the crosslinking agent is contained, the water resistance of the ink receiving layer is improved, and the lowering of ink absorbency due to that polyvinyl alcohol that has absorbed ink to cause swelling can be inhibited. In particular, the upper layer favorably contains the crosslinking agent. However, if the crosslinking agent is added too much, lowering of the color reproduction range due to the remaining unreacted crosslinking agent and occurrence of cracks due to embrittlement may be caused in some cases. Thus, an optimum amount of the crosslinking agent is favorably added. The amount of the crosslinking agent contained in the upper layer is favorably 0.2 equivalents or more and 1.2 equivalents or less, more favorably 0.2 equivalents or more and 1.0 equivalent or less, particularly favorably 0.5 equivalents or more and 1.0 equivalent or less, with respect to the polyvinyl alcohol in the upper layer.

Incidentally, with respect to "equivalent", the amount of the crosslinking agent theoretically completely reacting with the hydroxyl group of the polyvinyl alcohol is regarded as 1.0 equivalent. As the crosslinking agent, is favorably used boric acid or a salt thereof. Examples of boric acid include orthoboric acid ($H_3BO_3$), metaboric acid and hypoboric acid. Examples of the boric acid salt include orthoborates (for example, $InBO_3$, $ScBO_3$, $YBO_3$, $LaBO_3$, $Mg_3(BO_3)_2$ and $CO_3(BO_3)_2$), diborates (for example, $Mg_2B_2O_5$ and $CO_2B_2O_5$), metaborates (for example, $LiBO_2$, $Ca(BO_2)_2$, $NaBO_2$ and $KBO_2$), tetraborates (for example, $Na_2B_4O_7.10H_2O$), and pentaborates (for example, $KB_5O_8.4H_2O$, $Ca_2B_6O_{11}.7H_2O$ and $CsB_5O_5$). Among these, orthoboric acid is favorably used from the viewpoints of stability with time of a coating liquid and an inhibitory effect on occurrence of cracks.

The surface pH of the ink receiving layer is favorably controlled to 4.5 or more and 5.5 or less, more favorably 4.8 or more and 5.3 or less, still more favorably 5.0 or more and 5.2 or less. In order to control the surface pH to such a range, it is favorable to cause an alkylsulfonic acid to be contained in the ink receiving layer. The content of the alkylsulfonic acid in each of the upper and lower layers is favorably 1.3% by mass or more and 2.1% by mass or less based on the pigment. The content is controlled to 1.3% by mass or more and 2.1% by mass or less, whereby the surface pH of the ink receiving layer is easily controlled to 4.5 or more and 5.5 or less. The content is more favorably 1.4% by mass or more and 1.9% by mass or less. According to the alkylsulfonic acid, the pH of the ink receiving layer can be easily adjusted compared with a weak acid having a buffer function, such as formic acid, acetic acid or glycolic acid. An alkylsulfonic acid having 1 to 4 carbon atoms is favorable as the alkylsulfonic acid. Specific examples thereof include methanesulfonic acid, ethane-sulfonic acid, butanesulfonic acid and isopropanesulfonic acid. Among these, methanesulfonic acid is favorably used from the viewpoint of easy adjustment of the pH. Incidentally, a strong acid such as hydrochloric acid or nitric acid may also be used in addition to the alkylsulfonic acid.

The total layer thickness of the upper and lower layers is favorably 18.0 μm or more and 45.0 μm or less, more favorably 28.0 μm or more and 40.0 μm or less. If the total layer thickness is less than 18.0 μm, the pore volume of the ink receiving layer becomes insufficient with respect to the impacted amount of ink, and so bleeding due to insufficient absorption may occur in some cases. If the total layer thickness is larger than 45.0 μm, cracks may occur upon drying in some cases.

Other additives may be added into the upper and lower layers as needed. Examples of other additives include dispersants, thickeners, pH adjustors, lubricants, flowability modifiers, surfactants, antifoaming agents, parting agents, fluorescent whitening agents, ultraviolet absorbents and antioxidants.

As the substrate of the present invention, is favorably used a film or paper such as cast-coated paper, baryta paper or resin-coated paper (resin-coated paper with both surfaces thereof coated with a resin such as polyolefin). As the film, may be used films of the following transparent thermoplastic resins: polyethylene, polypropylene, polyester, polylactic acid, polystyrene, polyacetate, polyvinyl chloride, cellulose acetate, polyethylene terephthalate, polymethyl methacrylate and polycarbonate.

Besides the above, waterleaf paper or coat paper that is moderately sized paper, or a sheet material (synthetic paper or the like) formed of a film opacified by filling an inorganic material or by performing fine foaming may also be used. In addition, a sheet formed of glass or metal may also be used. Further, the surfaces of these substrates may also be subjected to a corona discharge treatment or various undercoating treatments for the purpose of improving adhesion strength between such a substrate and the ink receiving layer.

The present invention will hereinafter be described more specifically by the following Examples. Incidentally, "parts or part" in Examples means parts or part by mass.

Example 1

Preparation of Substrate

A substrate was prepared under the following conditions. A paper stock of the following composition was first prepared.

| | |
|---|---|
| Pulp slurry (3% by mass slurry obtained by dispersing Laubholz bleached kraft pulp (LBKP, freeness: 450 ml CSF (Canadian Standard Freeness)) and Nadelholz bleached kraft pulp (NBKP, freeness: 480 ml CSF) at a mass ratio of 8:2 in water) | 100.00 parts |
| Cationized starch | 0.60 parts |
| Ground calcium carbonate | 10.00 parts |
| Precipitated calcium carbonate | 15.00 parts |
| Alkyl ketene dimer | 0.10 parts |
| Cationic polyacrylamide | 0.03 parts. |

Paper was then made from this paper stock by a Fourdrinier paper machine followed by 3-stage wet pressing and drying by a multi-cylinder dryer. The resultant paper was then impregnated with an aqueous solution of oxidized starch by a size press device so as to give an impregnation amount of 1.0 g/m$^2$ in terms of solid content followed by drying. After the drying, the paper was finished by a machine calender to obtain a base paper having a basis weight of 170 g/m$^2$, a Stöckigt sizing degree of 100 seconds, a gas permeability of 50 seconds, a Bekk smoothness of 30 seconds and a Gurley stiffness of 11.0 mN. A resin composition composed of low density polyethylene (70 parts), high density polyethylene (20 parts) and titanium oxide (10 parts) was applied in an amount of 25 g/m$^2$ on one side of the resultant base paper. A resin composition composed of high density polyethylene (50 parts) and low density polyethylene (50 parts) was further applied in an amount of g/m$^2$ on the other side of the base paper, thereby preparing a resin-coated substrate.

Preparation of Ink Receiving Layer

Coating liquids for lower and upper layers were successively applied on the substrate and dried to prepare an ink receiving layer. At this time, the compositions and coating method of the respective coating liquids are as follows.

Lower Layer Coating Liquid

Alumina hydrate (trade name: Disperal HP10, product of Sasol Co.) was added into ion-exchanged water so as to give a concentration of 25% by mass. Methanesulfonic acid was then added in an amount of 1.4% by mass based on this alumina hydrate, and the resultant mixture was stirred to obtain a colloidal sol. The resultant colloidal sol was diluted with ion-exchanged water in such a manner that the concentration of the alumina hydrate is 21% by mass, thereby obtaining a colloidal sol A.

On the other hand, a gas phase process silica (trade name: AEROSIL 300, product of EVONIK Co.) was added into ion-exchanged water so as to give a concentration of 22% by mass. A cationic polymer (trade name: SHALLOL DC902P, product of DAI-ICHI KOGYO SEIYAKU CO., LTD.) was then added in an amount of 5.0% by mass based on this gas phase process silica, and the resultant mixture was stirred to obtain a colloidal sol. The resultant colloidal sol was diluted with ion-exchanged water in such a manner that the concentration of the gas phase process silica is 18% by mass, thereby obtaining a colloidal sol B.

The above colloidal sols A and B were mixed in such an amount that the mass ratio (alumina hydrate)/(gas phase process silica) is 25/75 to obtain a colloidal sol C.

On the other hand, polyvinyl alcohol (trade name: PVA 235, product of Kuraray Co., Ltd.; polymerization degree: 3,500, saponification degree: 88%) was dissolved in ion-exchange water to obtain an aqueous solution of polyvinyl alcohol having a solid content of 8.0% by mass. The resultant aqueous polyvinyl alcohol solution was mixed with the colloidal sol C prepared above in such a manner that the amount of the polyvinyl alcohol is 20% by mass based on the pigments (alumina hydrate+gas phase process silica). A 3.0% by mass aqueous solution of boric acid was mixed with the resultant mixture in such a manner that the amount of the boric acid is 22% by mass based on the polyvinyl alcohol, thereby obtaining a lower layer coating liquid.

Upper Layer Coating Liquid

Alumina hydrate (trade name: Disperal HP14, product of Sasol Co.) was added into ion-exchanged water so as to give a concentration of 30% by mass. Methanesulfonic acid was then added in an amount of 1.4% by mass based on this alumina hydrate, and the resultant mixture was stirred to obtain a colloidal sol. The resultant colloidal sol was diluted with ion-exchanged water in such a manner that the concentration of the alumina hydrate is 27% by mass, thereby obtaining a colloidal sol D.

On the other hand, polyvinyl alcohol (trade name: PVA 235, product of Kuraray Co., Ltd.; polymerization degree: 3,500, saponification degree: 88%) was dissolved in ion-exchange water to obtain an aqueous solution of polyvinyl alcohol having a solid content of 8.0% by mass. The resultant aqueous polyvinyl alcohol solution was mixed with the colloidal sol D prepared above in such a manner that the amount of the polyvinyl alcohol is 11.0% by mass based on the alumina hydrate. A 3.0% by mass aqueous solution of boric acid was mixed with the resultant mixture in such a manner that the amount of boric acid is 5.6% by mass based on the polyvinyl alcohol, thereby obtaining an upper layer coating liquid. The amount of the boric acid in the resultant upper layer coating liquid was 0.2 equivalents with respect to the polyvinyl alcohol in the upper layer coating liquid.

Coating Method of Ink Receiving Layers

The lower layer and upper layer coating liquids were simultaneously multilayeredly coated on the substrate 1 in such a manner that the layer thicknesses of the lower and upper layers are 30.0 μm and 5.0 μm respectively in this order from the substrate. The multilayer coating was conducted at a liquid temperature of 40° C. by means of a slide die. The substrate was then dried with hot air of 40° C. to prepare an ink jet recording medium.

Example 2

An ink jet recording medium was prepared in the same manner as in Example 1 except that the amount of the polyvinyl alcohol in the upper layer coating liquid in Example 1 was changed to 9.0% by mass based on the alumina hydrate, and the amount of the boric acid in the resultant upper layer coating liquid was 0.2 equivalents with respect to the polyvinyl alcohol in the upper layer coating liquid.

Example 3

An ink jet recording medium was prepared in the same manner as in Example 1 except that the amount of the polyvinyl alcohol in the upper layer coating liquid in Example 1 was changed to 7.0% by mass based on the alumina hydrate, and the amount of the boric acid in the resultant upper layer coating liquid was 0.2 equivalents with respect to the polyvinyl alcohol in the upper layer coating liquid.

Example 4

An ink jet recording medium was prepared in the same manner as in Example 1 except that the amount of the polyvinyl alcohol in the upper layer coating liquid in Example 1 was changed to 12.0% by mass based on the alumina hydrate, and the amount of the boric acid in the resultant upper layer coating liquid was 0.2 equivalents with respect to the polyvinyl alcohol in the upper layer coating liquid.

Example 5

An ink jet recording medium was prepared in the same manner as in Example 1 except that the amount of the polyvinyl alcohol in the upper layer coating liquid in Example 1 was changed to 5.0% by mass based on the alumina hydrate, and the amount of the boric acid in the resultant upper layer coating liquid was 0.2 equivalents with respect to the polyvinyl alcohol in the upper layer coating liquid.

Example 6

An ink jet recording medium was prepared in the same manner as in Example 2 except that the amount of the boric acid in the upper layer coating liquid in Example 2 was changed to 1.1% by mass based on the polyvinyl alcohol, and the amount of the boric acid in the resultant upper layer coating liquid was 0.04 equivalents with respect to the polyvinyl alcohol in the upper layer coating liquid.

Example 7

An ink jet recording medium was prepared in the same manner as in Example 2 except that the amount of the boric acid in the upper layer coating liquid in Example 2 was changed to 11% by mass based on the polyvinyl alcohol, and the amount of the boric acid in the resultant upper layer coating liquid was 0.4 equivalents with respect to the polyvinyl alcohol in the upper layer coating liquid.

Example 8

An ink jet recording medium was prepared in the same manner as in Example 2 except that the amount of the boric acid in the upper layer coating liquid in Example 2 was changed to 28% by mass based on the polyvinyl alcohol, and the amount of the boric acid in the resultant upper layer coating liquid was 1.0 equivalent with respect to the polyvinyl alcohol in the upper layer coating liquid.

Example 9

An ink jet recording medium was prepared in the same manner as in Example 2 except that no boric acid was contained in the upper layer coating liquid in Example 2.

Example 10

An ink jet recording medium was prepared in the same manner as in Example 2 except that no boric acid was contained in the upper layer coating liquid in Example 2, and no boric acid was also contained in the lower layer coating liquid.

Example 11

An ink jet recording medium was prepared in the same manner as in Example 2 except that the amount of the boric acid in the upper layer coating liquid in Example 2 was changed to 33% by mass based on the polyvinyl alcohol, and the amount of the boric acid in the resultant upper layer coating liquid was 1.2 equivalents with respect to the polyvinyl alcohol in the upper layer coating liquid.

Example 12

The composition of the upper layer coating liquid in Example 2 was changed as described below. First, two kinds of alumina hydrates (trade names: Disperal HP14 and HP18, products of Sasol Co.) were mixed and added into ion-exchanged water in such a manner that the mass ratio of HP14:HP18 is 80:20, and the total concentration of the alumina hydrates is 30% by mass. Methanesulfonic acid was then added in an amount of 1.4% by mass based on the alumina hydrates, and the resultant mixture was stirred to obtain a colloidal sol. The resultant colloidal sol was diluted with ion-exchanged water in such a manner that the total concentration of the alumina hydrates is 27% by mass, thereby obtaining a colloidal sol E.

On the other hand, polyvinyl alcohol (trade name: PVA 235, product of Kuraray Co., Ltd.; polymerization degree: 3,500, saponification degree: 88%) was dissolved in ion-exchange water to obtain an aqueous solution of polyvinyl alcohol having a solid content of 8.0% by mass. The resultant aqueous polyvinyl alcohol solution was mixed with the colloidal sol E prepared above in such a manner that the amount of the polyvinyl alcohol is 9.0% by mass based on the alumina hydrates. A 3.0% by mass aqueous solution of boric acid was mixed with the resultant mixture in such a manner that the amount of the boric acid is 5.6% by mass based on the polyvinyl alcohol, thereby obtaining an upper layer coating liquid. The amount of the boric acid in the resultant upper layer coating liquid was 0.2 equivalents with respect to the polyvinyl alcohol in the upper layer coating liquid.

An ink jet recording medium was prepared in the same manner as in Example 2 except for the above.

Example 13

An ink jet recording medium was prepared in the same manner as in Example 12 except that the two kinds of alumina hydrates (trade names: Disperal HP14 and HP18, products of Sasol Co.) in Example 12 were mixed in such a manner that the mass ratio of HP14:HP18 is 70:30.

Example 14

An ink jet recording medium was prepared in the same manner as in Example 12 except that the two kinds of alumina hydrates (trade names: Disperal HP14 and HP18, products of Sasol Co.) in Example 12 were mixed in such a manner that the mass ratio of HP14:HP18 is 60:40.

Example 15

An ink jet recording medium was prepared in the same manner as in Example 2 except that the amount of the polyvinyl alcohol in the lower layer coating liquid in Example 2 was changed to 17% by mass based on the pigments (alumina hydrate+gas phase process silica).

Example 16

An ink jet recording medium was prepared in the same manner as in Example 2 except that the amount of the polyvinyl alcohol in the lower layer coating liquid in Example 2 was changed to 22% by mass based on the pigments (alumina hydrate+gas phase process silica).

Example 17

An ink jet recording medium was prepared in the same manner as in Example 2 except that the amount of the polyvinyl alcohol in the lower layer coating liquid in Example 2 was changed to 25% by mass based on the pigments (alumina hydrate+gas phase process silica).

Example 18

An ink jet recording medium was prepared in the same manner as in Example 2 except that the mass ratio (alumina hydrate)/(gas phase process silica) in the lower layer coating liquid in Example 2 was changed to 5/95.

Example 19

An ink jet recording medium was prepared in the same manner as in Example 2 except that the mass ratio (alumina hydrate)/(gas phase process silica) in the lower layer coating liquid in Example 2 was changed to 10/90.

Example 20

An ink jet recording medium was prepared in the same manner as in Example 2 except that the mass ratio (alumina hydrate)/(gas phase process silica) in the lower layer coating liquid in Example 2 was changed to 20/80.

Example 21

An ink jet recording medium was prepared in the same manner as in Example 2 except that the alumina hydrate (trade name: Disperal HP10, product of Sasol Co.) in the lower layer coating liquid in Example 2 was changed to alumina hydrate (trade name: Disperal HP8, product of Sasol Co.).

Example 22

An ink jet recording medium was prepared in the same manner as in Example 2 except that the alumina hydrate (trade name: Disperal HP10, product of Sasol Co.) in the lower layer coating liquid in Example 2 was changed to alumina hydrate (trade name: Disperal HP14, product of Sasol Co.).

Example 23

An ink jet recording medium was prepared in the same manner as in Example 2 except that the mass ratio (alumina hydrate)/(gas phase process silica) in the lower layer coating liquid in Example 2 was changed to 30/70.

Example 24

An ink jet recording medium was prepared in the same manner as in Example 23 except that the alumina hydrate (trade name: Disperal HP10, product of Sasol Co.) in the lower layer coating liquid in Example 23 was changed to alumina hydrate (trade name: Disperal HP18, product of Sasol Co.).

Example 25

An ink jet recording medium was prepared in the same manner as in Example 2 except that the mass ratio (alumina hydrate)/(gas phase process silica) in the lower layer coating liquid in Example 2 was changed to 40/60.

Example 26

An ink jet recording medium was prepared in the same manner as in Example 2 except that the mass ratio (alumina hydrate)/(gas phase process silica) in the lower layer coating liquid in Example 2 was changed to 50/50.

Example 27

An ink jet recording medium was prepared in the same manner as in Example 2 except that the mass ratio (alumina hydrate)/(gas phase process silica) in the lower layer coating liquid in Example 2 was changed to 60/40.

Example 28

An ink jet recording medium was prepared in the same manner as in Example 2 except that the layer thickness of the lower layer in Example 2 was changed to 15.0 μm.

Example 29

An ink jet recording medium was prepared in the same manner as in Example 2 except that the layer thickness of the upper layer in Example 2 was changed to 3.0 μm.

Example 30

An ink jet recording medium was prepared in the same manner as in Example 2 except that the layer thickness of the upper layer in Example 2 was changed to 7.0 μm.

Example 31

An ink jet recording medium was prepared in the same manner as in Example 2 except that the layer thickness of the upper layer in Example 2 was changed to 8.0 μm.

Example 32

An ink jet recording medium was prepared in the same manner as in Example 2 except that the layer thickness of the upper layer in Example 2 was changed to 10.0 μm.

Example 33

An ink jet recording medium was prepared in the same manner as in Example 2 except that the layer thicknesses of the lower and upper layers in Example 2 were changed to 25.0 μm and 10.0 μm, respectively.

Example 34

An ink jet recording medium was prepared in the same manner as in Example 2 except that the methanesulfonic acid (MSA) in the lower and upper layer coating liquids in Example 2 was changed to ethanesulfonic acid (ESA).

Example 35

An ink jet recording medium was prepared in the same manner as in Example 2 except that a cationic emulsion 1 (the preparation process will be described below) was added into the upper layer coating liquid in Example 2 so as to give a concentration of 2.0% by mass based on the alumina hydrate.

Example 36

An ink jet recording medium was prepared in the same manner as in Example 35 except that the cationic emulsion 1 in Example 35 was added so as to give a concentration of 4.0% by mass based on the alumina hydrate.

Example 37

An ink jet recording medium was prepared in the same manner as in Example 35 except that the cationic emulsion 1 in Example 35 was added so as to give a concentration of 6.0% by mass based on the alumina hydrate.

Example 38

An ink jet recording medium was prepared in the same manner as in Example 2 except that the cationic emulsion 1 was added into the upper layer coating liquid in Example 2 so as to give a concentration of 2.0% by mass based on the alumina hydrate, and the cationic emulsion 1 was added into the lower layer coating liquid so as to give a concentration of 2.0% by mass based on the pigments (alumina hydrate+gas phase process silica).

Example 39

An ink jet recording medium was prepared in the same manner as in Example 2 except that the methanesulfonic acid (MSA) in the lower and upper layer coating liquids in Example 2 was changed to acetic acid.

Example 40

An ink jet recording medium was prepared in the same manner as in Example 12 except that the two kinds of alumina hydrates (trade names: Disperal HP14 and HP18, products of Sasol Co.) in Example 12 were mixed in such a manner that the mass ratio of HP14:HP18 is 40:60.

Example 41

An ink jet recording medium was prepared in the same manner as in Example 13 except that the alumina hydrate (trade name: Disperal HP18, product of Sasol Co.) in the upper layer coating liquid in Example 13 was changed to alumina hydrate (trade name: Disperal HP22, product of Sasol Co.).

Example 42

The composition of the upper layer coating liquid in Example 2 was changed as described below. First, alumina hydrate (trade names: Disperal HP14, product of Sasol Co.) and a gas phase process silica (trade name: AEROSIL 300, product of EVONIK Co.) were mixed and added into ion-exchanged water in such a manner that the mass ratio of HP14:AEROSIL 300 is 95:5, and the total concentration of the pigments is 30% by mass. Methanesulfonic acid was then added in an amount of 1.4% by mass based on the pigments, and the resultant mixture was stirred to obtain a colloidal sol. The resultant colloidal sol was diluted with ion-exchanged water in such a manner that the total concentration of the pigments is 27% by mass, thereby obtaining a colloidal sol F.

On the other hand, polyvinyl alcohol (trade name: PVA 235, product of Kuraray Co., Ltd.; polymerization degree: 3,500, saponification degree: 88%) was dissolved in ion-exchange water to obtain an aqueous solution of polyvinyl alcohol having a solid content of 8.0% by mass. The resultant aqueous polyvinyl alcohol solution was mixed with the colloidal sol F prepared above in such a manner that the amount of the polyvinyl alcohol is 9.0% by mass based on the pigments. A 3.0% by mass aqueous solution of boric acid was mixed with the resultant mixture in such a manner that the amount of the boric acid is 5.6% by mass based on the polyvinyl alcohol, thereby obtaining an upper layer coating liquid. The amount of the boric acid in the resultant upper layer coating liquid was 0.2 equivalents with respect to the polyvinyl alcohol in the upper layer coating liquid.

An ink jet recording medium was prepared in the same manner as in Example 2 except for the above.

Comparative Example 1

An ink jet recording medium was prepared in the same manner as in Example 2 except that the amount of the polyvinyl alcohol in the lower layer coating liquid in Example 2 was changed to 15% by mass based on the pigments (alumina hydrate+gas phase process silica).

Comparative Example 2

An ink jet recording medium was prepared in the same manner as in Example 2 except that the mass ratio (alumina hydrate)/(gas phase process silica) in the lower layer coating liquid in Example 2 was changed to 100/0.

Comparative Example 3

An ink jet recording medium was prepared in the same manner as in Example 2 except that the alumina hydrate (trade name: Disperal HP10, product of Sasol Co.) in the lower layer coating liquid in Example 2 was changed to alumina hydrate (trade name: Disperal HP22, product of Sasol Co.).

Comparative Example 4

An ink jet recording medium was prepared in the same manner as in Example 2 except that the mass ratio (alumina hydrate)/(gas phase process silica) in the lower layer coating liquid in Example 2 was changed to 0/100.

Comparative Example 5

An ink jet recording medium was prepared in the same manner as in Example 2 except that the layer thickness of the upper layer in Example 2 was changed to 2.0 μm.

Comparative Example 6

An ink jet recording medium was prepared in the same manner as in Example 2 except that the layer thicknesses of the lower and upper layers in Example 2 were changed to 20.0 μm and 10.0 μm, respectively.

Comparative Example 7

An ink jet recording medium was prepared in the same manner as in Example 2 except that the layer thicknesses of the lower and upper layers in Example 2 were changed to 25.0 μm and 15.0 μm, respectively.

Comparative Example 8

An ink jet recording medium was prepared in the same manner as in Example 2 except that the layer thickness of the upper layer in Example 2 was changed to 15.0 μm.

Comparative Example 9

An ink jet recording medium was prepared in the same manner as in Example 5 except that the amount of the polyvinyl alcohol in the lower layer coating liquid in Example 5 was changed to 16% by mass based on the pigments (alumina hydrate+gas phase process silica).

Preparation Process of Cationic Emulsion

The cationic emulsion was prepared in the following manner. First, a reaction vessel equipped with a stirrer, a thermometer and a flux condenser was charged with 109.00 g of acetone, and then 40.00 g of 3,6-dithia-1,8-octanediol and 6.79 g of methyldiethanolamine were dissolved therein under stirring. After the dissolution, the resultant solution was heated to 40° C., and 62.07 g of isophorone diisocyanate was added thereto. Thereafter, the resultant mixture was heated to 50° C., 0.20 g of a tin catalyst was added, and the mixture was heated further to 55° C. to conduct a reaction for 4 hours with stirring. After completion of the reaction, the reaction mixture was cooled to room temperature (25° C.), and 3.09 g of 85% by mass formic acid was added to cationize the reaction product. After 446.00 g of water was additionally added, the resultant mixture was concentrated under reduced pressure to remove acetone, and the concentration of the mixture was adjusted with water, thereby preparing a cationic emulsion having a solid content of 20% by mass. The average particle size of the resultant cationic emulsion was measured by means of a laser particle size analysis system (trade name: PAR III. manufactured by OTSUKA ELECTRONICS Co., Ltd.). As a result, the average particle size was 50 nm.

Measurement of Average Pore Radii of Upper and Lower Layers

Respective single layer samples of upper and lower layers of each of the ink jet recording media of Examples and Comparative Examples were prepared. The substrate, and coating and drying conditions were the same as in the preparation of the two-layer sample. The average pore radii of upper and lower layers were measured on the samples thus prepared. Details of the measurement are as follows.

Automatic specific surface area and pore distribution measuring apparatus (trade name: TriStar 3000, manufactured by SHIMADZU CORP.)

Pretreatment of sample: Pretreatment apparatus for test (trade name: VacPrep 061, manufactured by SHIMADZU CORP.).

Each sample was cut into a size of 5.0×10 cm, and this cut recording medium was then cut into a size capable of being put in a ⅜-inch cell. This sample piece was put into the cell, and degassed and dried down to 20 mTorr or less by means of VacPrep 061 while heating to 80° C. according to the manual. With respect to the sample piece degassed and dried, the average pore radius thereof was measured by the nitrogen absorption/adsorption method using TriStar 3000 according to the manual. After the measurement, the data obtained on the nitrogen desorption side was used to obtain an average pore radius value of each sample.

The results are shown in Table 1 (upper layer), Table 2 (lower layer) and Table 3 (the whole ink receiving layer). Incidentally, the Martens hardness and elastic deformation work rate of the ink receiving layer were measured by a hardness meter (trade name: PICODENTOR HM-50, manufactured by Fischer Instruments K.K.). In Table 3, "-" indicates that evaluation could not be made because cracks occurred in the recording medium.

TABLE 1

| | Upper layer | | | | | | | | | | |
|---|---|---|---|---|---|---|---|---|---|---|---|
| | | | | | | Compositional ratio | | | | | |
| | Pigment | | Defloc-culating | Layer thickness | Average pore radius | Pigment 1 | Pigment 2 | Defloc-culating acid | Cationic emulsion | PVA % by | Boric acid % by |
| | Pigment 1 | Pigment 2 | acid | μm | nm | % by mass | % by mass | % by mass | % by mass | mass | mass |
| Ex. 1 | HP-14 | — | MSA | 5.0 | 9.80 | 88.5 | 0.0 | 1.2 | 0.0 | 9.7 | 0.5 |
| Ex. 2 | HP-14 | — | MSA | 5.0 | 9.80 | 90.2 | 0.0 | 1.3 | 0.0 | 8.1 | 0.5 |
| Ex. 3 | HP-14 | — | MSA | 5.0 | 9.80 | 91.9 | 0.0 | 1.3 | 0.0 | 6.4 | 0.4 |
| Ex. 4 | HP-14 | — | MSA | 5.0 | 9.80 | 87.7 | 0.0 | 1.2 | 0.0 | 10.5 | 0.6 |
| Ex. 5 | HP-14 | — | MSA | 5.0 | 9.80 | 93.7 | 0.0 | 1.3 | 0.0 | 4.7 | 0.3 |
| Ex. 6 | HP-14 | — | MSA | 5.0 | 9.80 | 90.5 | 0.0 | 1.3 | 0.0 | 8.1 | 0.1 |
| Ex. 7 | HP-14 | — | MSA | 5.0 | 9.80 | 89.8 | 0.0 | 1.3 | 0.0 | 8.1 | 0.9 |
| Ex. 8 | HP-14 | — | MSA | 5.0 | 9.80 | 88.6 | 0.0 | 1.2 | 0.0 | 8.0 | 2.2 |
| Ex. 9 | HP-14 | — | MSA | 5.0 | 9.80 | 90.6 | 0.0 | 1.3 | 0.0 | 8.2 | 0.0 |
| Ex. 10 | HP-14 | — | MSA | 5.0 | 9.80 | 90.6 | 0.0 | 1.3 | 0.0 | 8.2 | 0.0 |
| Ex. 11 | HP-14 | — | MSA | 5.0 | 9.80 | 88.2 | 0.0 | 1.2 | 0.0 | 7.9 | 2.6 |
| Ex. 12 | HP-14 | HP-18 | MSA | 5.0 | 10.56 | 72.1 | 18.0 | 1.3 | 0.0 | 8.1 | 0.5 |
| Ex. 13 | HP-14 | HP-18 | MSA | 5.0 | 10.94 | 63.1 | 27.1 | 1.3 | 0.0 | 8.1 | 0.5 |
| Ex. 14 | HP-14 | HP-18 | MSA | 5.0 | 11.32 | 54.1 | 36.1 | 1.3 | 0.0 | 8.1 | 0.5 |
| Ex. 15 | HP-14 | — | MSA | 5.0 | 9.80 | 90.2 | 0.0 | 1.3 | 0.0 | 8.1 | 0.5 |
| Ex. 16 | HP-14 | — | MSA | 5.0 | 9.80 | 90.2 | 0.0 | 1.3 | 0.0 | 8.1 | 0.5 |
| Ex. 17 | HP-14 | — | MSA | 5.0 | 9.80 | 90.2 | 0.0 | 1.3 | 0.0 | 8.1 | 0.5 |
| Ex. 18 | HP-14 | — | MSA | 5.0 | 9.80 | 90.2 | 0.0 | 1.3 | 0.0 | 8.1 | 0.5 |
| Ex. 19 | HP-14 | — | MSA | 5.0 | 9.80 | 90.2 | 0.0 | 1.3 | 0.0 | 8.1 | 0.5 |
| Ex. 20 | HP-14 | — | MSA | 5.0 | 9.80 | 90.2 | 0.0 | 1.3 | 0.0 | 8.1 | 0.5 |
| Ex. 21 | HP-14 | — | MSA | 5.0 | 9.80 | 90.2 | 0.0 | 1.3 | 0.0 | 8.1 | 0.5 |
| Ex. 22 | HP-14 | — | MSA | 5.0 | 9.80 | 90.2 | 0.0 | 1.3 | 0.0 | 8.1 | 0.5 |
| Ex. 23 | HP-14 | — | MSA | 5.0 | 9.80 | 90.2 | 0.0 | 1.3 | 0.0 | 8.1 | 0.5 |
| Ex. 24 | HP-14 | — | MSA | 5.0 | 9.80 | 90.2 | 0.0 | 1.3 | 0.0 | 8.1 | 0.5 |
| Ex. 25 | HP-14 | — | MSA | 5.0 | 9.80 | 90.2 | 0.0 | 1.3 | 0.0 | 8.1 | 0.5 |
| Ex. 26 | HP-14 | — | MSA | 5.0 | 9.80 | 90.2 | 0.0 | 1.3 | 0.0 | 8.1 | 0.5 |
| Ex. 27 | HP-14 | — | MSA | 5.0 | 9.80 | 90.2 | 0.0 | 1.3 | 0.0 | 8.1 | 0.5 |
| Ex. 28 | HP-14 | — | MSA | 5.0 | 9.80 | 90.2 | 0.0 | 1.3 | 0.0 | 8.1 | 0.5 |
| Ex. 29 | HP-14 | — | MSA | 3.0 | 9.80 | 90.2 | 0.0 | 1.3 | 0.0 | 8.1 | 0.5 |
| Ex. 30 | HP-14 | — | MSA | 7.0 | 9.80 | 90.2 | 0.0 | 1.3 | 0.0 | 8.1 | 0.5 |
| Ex. 31 | HP-14 | — | MSA | 8.0 | 9.80 | 90.2 | 0.0 | 1.3 | 0.0 | 8.1 | 0.5 |
| Ex. 32 | HP-14 | — | MSA | 10.0 | 9.80 | 90.2 | 0.0 | 1.3 | 0.0 | 8.1 | 0.5 |
| Ex. 33 | HP-14 | — | MSA | 10.0 | 9.80 | 90.2 | 0.0 | 1.3 | 0.0 | 8.1 | 0.5 |
| Ex. 34 | HP-14 | — | ESA | 5.0 | 9.80 | 90.2 | 0.0 | 1.3 | 0.0 | 8.1 | 0.5 |
| Ex. 35 | HP-14 | — | MSA | 5.0 | 9.80 | 90.2 | 0.0 | 1.3 | 1.8 | 8.1 | 0.5 |
| Ex. 36 | HP-14 | — | MSA | 5.0 | 9.80 | 90.2 | 0.0 | 1.3 | 3.6 | 8.1 | 0.5 |
| Ex. 37 | HP-14 | — | MSA | 5.0 | 9.80 | 90.2 | 0.0 | 1.3 | 5.4 | 8.1 | 0.5 |
| Ex. 38 | HP-14 | — | MSA | 5.0 | 9.80 | 90.2 | 0.0 | 1.3 | 1.8 | 8.1 | 0.5 |
| Ex. 39 | HP-14 | | Acetic acid | 5.0 | 9.80 | 90.2 | 0.0 | 1.3 | 0.0 | 8.1 | 0.5 |

TABLE 1-continued

| | Upper layer | | | | | | | | | | |
|---|---|---|---|---|---|---|---|---|---|---|---|
| | | | | | | Compositional ratio | | | | | |
| | Pigment | | Defloc-culating | Layer thickness | Average pore radius | Pigment 1 | Pigment 2 | Defloc-culating acid | Cationic emulsion | PVA % by | Boric acid % by |
| | Pigment 1 | Pigment 2 | acid | μm | nm | % by mass | % by mass | % by mass | % by mass | mass | mass |
| Ex. 40 | HP-14 | HP-18 | MSA | 5.0 | 12.8 | 36.1 | 54.1 | 1.3 | 0.0 | 8.1 | 0.5 |
| Ex. 41 | HP-14 | HP-22 | MSA | 5.0 | 11.99 | 63.1 | 27.1 | 1.3 | 0.0 | 8.1 | 0.5 |
| Ex. 42 | HP-14 | Aerosil 300 | MSA | 5.0 | 9.96 | 85.7 | 4.5 | 1.3 | 0.0 | 8.1 | 0.5 |
| Comp. Ex 1 | HP-14 | | MSA | 5.0 | 9.80 | 90.2 | 0.0 | 1.3 | 0.0 | 8.1 | 0.5 |
| Comp Ex. 2 | HP-14 | | MSA | 5.0 | 9.80 | 90.2 | 0.0 | 1.3 | 0.0 | 8.1 | 0.5 |
| Comp Ex. 3 | HP-14 | | MSA | 5.0 | 9.80 | 90.2 | 0.0 | 1.3 | 0.0 | 8.1 | 0.5 |
| Comp Ex. 4 | HP-14 | | MSA | 5.0 | 9.80 | 90.2 | 0.0 | 1.3 | 0.0 | 8.1 | 0.5 |
| Comp Ex. 5 | HP-14 | | MSA | 2.0 | 9.80 | 90.2 | 0.0 | 1.3 | 0.0 | 8.1 | 0.5 |
| Comp Ex. 6 | HP-14 | | MSA | 10.0 | 9.80 | 90.2 | 0.0 | 1.3 | 0.0 | 8.1 | 0.5 |
| Comp Ex. 7 | HP-14 | | MSA | 15.0 | 9.80 | 90.2 | 0.0 | 1.3 | 0.0 | 8.1 | 0.5 |
| Comp Ex. 8 | HP-14 | | MSA | 15.0 | 9.80 | 90.2 | 0.0 | 1.3 | 0.0 | 8.1 | 0.5 |
| Comp Ex. 9 | HP-14 | | MSA | 5.0 | 9.80 | 93.7 | 0.0 | 1.3 | 0.0 | 4.7 | 0.3 |

TABLE 2

| | Lower layer | | | | | | | | | | | |
|---|---|---|---|---|---|---|---|---|---|---|---|---|
| | | | | | | Compositional ratio | | | | | | |
| | Pigment | | Defloc-culating | Layer thickness | Average pore radius | Pigment 1 | Pigment 2 | Defloc-culating acid | Cationic polymer | Cationic emulsion | PVA % by | Boric acid % by |
| | Pigment 1 | Pigment 2 | acid | μm | nm | % by mass | % by mass | % by mass | % by mass | % by mass | mass | mass |
| Ex. 1 | HP-10 | Aerosil300 | MSA | 30.0 | 11.73 | 19.3 | 57.8 | 0.3 | 3.9 | 0.0 | 15.4 | 3.4 |
| Ex. 2 | HP-10 | Aerosil300 | MSA | 30.0 | 11.73 | 19.3 | 57.8 | 0.3 | 3.9 | 0.0 | 15.4 | 3.4 |
| Ex. 3 | HP-10 | Aerosil300 | MSA | 30.0 | 11.73 | 19.3 | 57.8 | 0.3 | 3.9 | 0.0 | 15.4 | 3.4 |
| Ex. 4 | HP-10 | Aerosil300 | MSA | 30.0 | 11.73 | 19.3 | 57.8 | 0.3 | 3.9 | 0.0 | 15.4 | 3.4 |
| Ex. 5 | HP-10 | Aerosil300 | MSA | 30.0 | 11.73 | 19.3 | 57.8 | 0.3 | 3.9 | 0.0 | 15.4 | 3.4 |
| Ex. 6 | HP-10 | Aerosil300 | MSA | 30.0 | 11.73 | 19.3 | 57.8 | 0.3 | 3.9 | 0.0 | 15.4 | 3.4 |
| Ex. 7 | HP-10 | Aerosil300 | MSA | 30.0 | 11.73 | 19.3 | 57.8 | 0.3 | 3.9 | 0.0 | 15.4 | 3.4 |
| Ex. 8 | HP-10 | Aerosil300 | MSA | 30.0 | 11.73 | 19.3 | 57.8 | 0.3 | 3.9 | 0.0 | 15.4 | 3.4 |
| Ex. 9 | HP-10 | Aerosil300 | MSA | 30.0 | 11.73 | 19.3 | 57.8 | 0.3 | 3.9 | 0.0 | 15.4 | 3.4 |
| Ex. 10 | HP-10 | Aerosil300 | MSA | 30.0 | 11.73 | 19.9 | 59.8 | 0.3 | 4.0 | 0.0 | 16.0 | 0.0 |
| Ex. 11 | HP-10 | Aerosil300 | MSA | 30.0 | 11.73 | 19.3 | 57.8 | 0.3 | 3.9 | 0.0 | 15.4 | 3.4 |
| Ex. 12 | HP-10 | Aerosil300 | MSA | 30.0 | 11.73 | 19.3 | 57.8 | 0.3 | 3.9 | 0.0 | 15.4 | 3.4 |
| Ex. 13 | HP-10 | Aerosil300 | MSA | 30.0 | 11.73 | 19.3 | 57.8 | 0.3 | 3.9 | 0.0 | 15.4 | 3.4 |
| Ex. 14 | HP-10 | Aerosil300 | MSA | 30.0 | 11.73 | 19.3 | 57.8 | 0.3 | 3.9 | 0.0 | 15.4 | 3.4 |
| Ex. 15 | HP-10 | Aerosil300 | MSA | 30.0 | 11.73 | 19.8 | 59.5 | 0.3 | 4.0 | 0.0 | 13.5 | 3.0 |
| Ex. 16 | HP-10 | Aerosil300 | MSA | 30.0 | 11.73 | 18.9 | 56.7 | 0.3 | 3.8 | 0.0 | 16.6 | 3.7 |
| Ex. 17 | HP-10 | Aerosil300 | MSA | 30.0 | 11.73 | 18.4 | 55.2 | 0.3 | 3.7 | 0.0 | 18.4 | 4.0 |
| Ex. 18 | HP-10 | Aerosil300 | MSA | 30.0 | 12.67 | 3.9 | 73.4 | 0.1 | 3.9 | 0.0 | 15.4 | 3.4 |
| Ex. 19 | HP-10 | Aerosil300 | MSA | 30.0 | 12.43 | 7.7 | 69.5 | 0.1 | 3.9 | 0.0 | 15.4 | 3.4 |
| Ex. 20 | HP-10 | Aerosil300 | MSA | 30.0 | 11.96 | 15.4 | 61.7 | 0.2 | 3.9 | 0.0 | 15.4 | 3.4 |
| Ex. 21 | HP-8 | Aerosil300 | MSA | 30.0 | 10.88 | 19.3 | 57.8 | 0.3 | 3.9 | 0.0 | 15.4 | 3.4 |
| Ex. 22 | HP-14 | Aerosil300 | MSA | 30.0 | 12.33 | 19.3 | 57.8 | 0.3 | 3.9 | 0.0 | 15.4 | 3.4 |
| Ex. 23 | HP-10 | Aerosil300 | MSA | 30.0 | 11.49 | 23.1 | 53.9 | 0.3 | 3.9 | 0.0 | 15.4 | 3.4 |
| Ex. 24 | HP-18 | Aerosil300 | MSA | 30.0 | 12.78 | 23.1 | 53.9 | 0.3 | 3.9 | 0.0 | 15.4 | 3.4 |
| Ex. 25 | HP-10 | Aerosil300 | MSA | 30.0 | 11.02 | 30.8 | 46.2 | 0.4 | 3.8 | 0.0 | 15.4 | 3.4 |
| Ex. 26 | HP-10 | Aerosil300 | MSA | 30.0 | 10.55 | 38.4 | 38.4 | 0.5 | 3.8 | 0.0 | 15.4 | 3.4 |
| Ex. 27 | HP-10 | Aerosil300 | MSA | 30.0 | 10.08 | 46.1 | 30.7 | 0.6 | 3.8 | 0.0 | 15.4 | 3.4 |
| Ex. 28 | HP-10 | Aerosil300 | MSA | 15.0 | 11.73 | 19.3 | 57.8 | 0.3 | 3.9 | 0.0 | 15.4 | 3.4 |
| Ex. 29 | HP-10 | Aerosil300 | MSA | 30.0 | 11.73 | 19.3 | 57.8 | 0.3 | 3.9 | 0.0 | 15.4 | 3.4 |
| Ex. 30 | HP-10 | Aerosil300 | MSA | 30.0 | 11.73 | 19.3 | 57.8 | 0.3 | 3.9 | 0.0 | 15.4 | 3.4 |
| Ex. 31 | HP-10 | Aerosil300 | MSA | 30.0 | 11.73 | 19.3 | 57.8 | 0.3 | 3.9 | 0.0 | 15.4 | 3.4 |
| Ex. 32 | HP-10 | Aerosil300 | MSA | 30.0 | 11.73 | 19.3 | 57.8 | 0.3 | 3.9 | 0.0 | 15.4 | 3.4 |
| Ex. 33 | HP-10 | Aerosil300 | MSA | 25.0 | 11.73 | 19.3 | 57.8 | 0.3 | 3.9 | 0.0 | 15.4 | 3.4 |
| Ex. 34 | HP-10 | Aerosil300 | ESA | 30.0 | 11.73 | 19.3 | 57.8 | 0.3 | 3.9 | 0.0 | 15.4 | 3.4 |
| Ex. 35 | HP-10 | Aerosil300 | MSA | 30.0 | 11.73 | 19.3 | 57.8 | 0.3 | 3.9 | 0.0 | 15.4 | 3.4 |
| Ex. 36 | HP-10 | Aerosil300 | MSA | 30.0 | 11.73 | 19.3 | 57.8 | 0.3 | 3.9 | 0.0 | 15.4 | 3.4 |
| Ex. 37 | HP-10 | Aerosil300 | MSA | 30.0 | 11.73 | 19.3 | 57.8 | 0.3 | 3.9 | 0.0 | 15.4 | 3.4 |
| Ex. 38 | HP-10 | Aerosil300 | MSA | 30.0 | 11.73 | 19.0 | 56.9 | 0.3 | 3.8 | 1.5 | 15.2 | 3.3 |
| Ex. 39 | HP-10 | Aerosil300 | Acetic acid | 30.0 | 11.73 | 19.3 | 57.8 | 0.3 | 3.9 | 0.0 | 15.4 | 3.4 |
| Ex. 40 | HP-10 | Aerosil300 | MSA | 30.0 | 11.73 | 19.3 | 57.8 | 0.3 | 3.9 | 0.0 | 15.4 | 3.4 |
| Ex. 41 | HP-10 | Aerosil300 | MSA | 30.0 | 11.73 | 19.3 | 57.8 | 0.3 | 3.9 | 0.0 | 15.4 | 3.4 |
| Ex. 42 | HP-10 | Aerosil300 | MSA | 30.0 | 11.73 | 19.3 | 57.8 | 0.3 | 3.9 | 0.0 | 15.4 | 3.4 |

TABLE 2-continued

| | Lower layer | | | | | | | | | | | |
|---|---|---|---|---|---|---|---|---|---|---|---|---|
| | | | | | | Compositional ratio | | | | | | |
| | Pigment | | Defloc-culating | Layer thickness | Average pore radius | Pigment 1 | Pigment 2 | Defloc-culating acid | Cationic polymer | Cationic emulsion | PVA % by | Boric acid % by |
| | Pigment 1 | Pigment 2 | acid | μm | nm | % by mass | % by mass | % by mass | % by mass | % by mass | mass | mass |
| Comp Ex. 1 | HP-10 | Aerosil300 | MSA | 30.0 | 11.73 | 20.2 | 60.7 | 0.3 | 4.0 | 0.0 | 12.1 | 2.7 |
| Comp Ex. 2 | HP-10 | | MSA | 30.0 | 8.20 | 76.5 | 0.0 | 1.1 | 3.8 | 0.0 | 15.3 | 3.4 |
| Comp Ex. 3 | HP-22 | Aerosil300 | MSA | 30.0 | 13.94 | 19.3 | 57.8 | 0.3 | 3.9 | 0.0 | 15.4 | 3.4 |
| Comp Ex. 4 | | Aerosil300 | MSA | 30.0 | 12.90 | 0.0 | 77.3 | 0.3 | 3.9 | 0.0 | 15.5 | 3.4 |
| Comp Ex. 5 | HP-10 | Aerosil300 | MSA | 30.0 | 11.73 | 19.3 | 57.8 | 0.3 | 3.9 | 0.0 | 15.4 | 3.4 |
| Comp Ex. 6 | HP-10 | Aerosil300 | MSA | 20.0 | 11.73 | 19.3 | 57.8 | 0.3 | 3.9 | 0.0 | 15.4 | 3.4 |
| Comp Ex. 7 | HP-10 | Aerosil300 | MSA | 25.0 | 11.73 | 19.3 | 57.8 | 0.3 | 3.9 | 0.0 | 15.4 | 3.4 |
| Comp Ex. 8 | HP-10 | Aerosil300 | MSA | 30.0 | 11.73 | 19.3 | 57.8 | 0.3 | 3.9 | 0.0 | 15.4 | 3.4 |
| Comp Ex. 9 | HP-10 | Aerosil300 | MSA | 30.0 | 11.73 | 20.0 | 60.1 | 0.3 | 4.0 | 0.0 | 12.8 | 2.8 |

TABLE 3

| | The whole ink receiving layer | | | | |
|---|---|---|---|---|---|
| | Total PVA amount % by mass | Layer thickness ratio (lower layer/upper layer) | Average pore radius ratio (lower layer/upper layer) | Martens hardness N/mm$^2$ | Elastic defor-mation work rate % |
| Ex. 1 | 14.6 | 6.0 | 1.20 | 59.0 | 43.5 |
| Ex. 2 | 14.4 | 6.0 | 1.20 | 57.0 | 42.9 |
| Ex. 3 | 14.1 | 6.0 | 1.20 | 55.0 | 41.5 |
| Ex. 4 | 14.7 | 6.0 | 1.20 | 60.0 | 44.0 |
| Ex. 5 | 13.9 | 6.0 | 1.20 | 55.0 | 39.8 |
| Ex. 6 | 14.4 | 6.0 | 1.20 | 51.0 | 42.9 |
| Ex. 7 | 14.4 | 6.0 | 1.20 | 53.0 | 42.4 |
| Ex. 8 | 14.4 | 6.0 | 1.20 | 57.0 | 41.1 |
| Ex. 9 | 14.4 | 6.0 | 1.20 | 49.0 | 34.9 |
| Ex. 10 | 14.8 | 6.0 | 1.20 | 49.0 | 33.6 |
| Ex. 11 | 14.3 | 6.0 | 1.20 | 58.0 | 41.0 |
| Ex. 12 | 14.4 | 6.0 | 1.11 | 57.0 | 42.8 |
| Ex. 13 | 14.4 | 6.0 | 1.07 | 57.0 | 42.8 |
| Ex. 14 | 14.4 | 6.0 | 1.04 | 58.0 | 42.7 |
| Ex. 15 | 12.7 | 6.0 | 1.20 | 54.0 | 41.0 |
| Ex. 16 | 15.4 | 6.0 | 1.20 | 56.0 | 43.0 |
| Ex. 17 | 16.9 | 6.0 | 1.20 | 58.0 | 43.3 |
| Ex. 18 | 14.4 | 6.0 | 1.29 | 49.0 | 46.8 |
| Ex. 19 | 14.4 | 6.0 | 1.27 | 51.0 | 45.1 |
| Ex. 20 | 14.4 | 6.0 | 1.22 | 53.0 | 44.0 |
| Ex. 21 | 14.4 | 6.0 | 1.11 | 55.0 | 42.9 |
| Ex. 22 | 14.4 | 6.0 | 1.26 | 55.0 | 42.7 |
| Ex. 23 | 14.4 | 6.0 | 1.17 | 56.0 | 42.2 |
| Ex. 24 | 14.4 | 6.0 | 1.30 | 56.0 | 42.6 |
| Ex. 25 | 14.4 | 6.0 | 1.12 | 58.0 | 41.9 |
| Ex. 26 | 14.3 | 6.0 | 1.08 | 59.0 | 41.7 |
| Ex. 27 | 14.3 | 6.0 | 1.03 | 60.0 | 41.5 |
| Ex. 28 | 14.8 | 10 | 1.20 | 52.0 | 40.0 |
| Ex. 29 | 14.4 | 6.0 | 1.20 | 50.0 | 44.0 |
| Ex. 30 | 14.0 | 4.3 | 1.20 | 54.0 | 42.1 |
| Ex. 31 | 13.9 | 3.8 | 1.20 | 57.0 | 41.9 |
| Ex. 32 | 13.6 | 3.0 | 1.20 | 59.0 | 39.9 |
| Ex. 33 | 13.3 | 2.5 | 1.20 | 59.0 | 38.8 |
| Ex. 34 | 14.4 | 6.0 | 1.20 | 55.0 | 42.8 |
| Ex. 35 | 14.6 | 6.0 | 1.20 | 56.0 | 43.4 |
| Ex. 36 | 14.9 | 6.0 | 1.20 | 58.0 | 44.2 |
| Ex . 37 | 15.1 | 6.0 | 1.20 | 60.0 | 45.6 |
| Ex. 38 | 15.7 | 6.0 | 1.20 | 58.0 | 43.8 |
| Ex. 39 | 14.4 | 6.0 | 1.20 | 55.0 | 42.7 |
| Ex. 40 | 14.4 | 6.0 | 0.97 | 57.0 | 42.7 |
| Ex. 41 | 14.4 | 6.0 | 0.98 | 57.0 | 42.8 |
| Ex. 42 | 14.4 | 6.0 | 1.18 | 57.0 | 42.9 |
| Comp. Ex. 1 | 11.6 | 6.0 | 1.20 | | |
| Comp. Ex. 2 | 14.3 | 6.0 | 0.84 | 59.0 | 42.0 |

TABLE 3-continued

| | The whole ink receiving layer | | | | |
|---|---|---|---|---|---|
| | Total PVA amount % by mass | Layer thickness ratio (lower layer/upper layer) | Average pore radius ratio (lower layer/upper layer) | Martens hardness N/mm$^2$ | Elastic defor-mation work rate % |
| Comp. Ex. 3 | 14.4 | 6.0 | 1.42 | 56.0 | 42.6 |
| Comp. Ex 4 | 14.4 | 6.0 | 1.32 | 45.0 | 47.8 |
| Comp. Ex. 5 | 15.0 | 15 | 1.20 | 48.0 | 46.0 |
| Comp. Ex 6 | 13.0 | 2.0 | 1.20 | 55.0 | 34.8 |
| Comp. Ex 7 | 12.7 | 1.7 | 1.20 | 62.0 | 32.8 |
| Comp. Ex 8 | 13.0 | 2.0 | 1.20 | 61.0 | 33.3 |
| Comp. Ex 9 | 11.7 | 6.0 | 1.20 | 52.0 | 34.5 |

Evaluation

The ink jet recording media of Examples and Comparative Examples were subjected to the following evaluations.

1) Ink Absorbency

A green solid image (image of 100% duty) was recorded on each of the recording media by a platinum mode (default setting) of an ink jet recording apparatus (trade name: PIXUS MP990, manufactured by Canon Inc.). The solid image was observed with naked eyes and through an electron microscope to evaluate the ink absorbency according to the following criteria.

Evaluation Criteria

Rank 4: No ink overflowing was observed even through the electron microscope, and the image was even;

Rank 3: Ink overflowing was not observed with naked eyes, but was slightly observed through the electron microscope;

Rank 2: Ink overflowing was slightly observed even with naked eyes, and color unevenness occurred on the image;

Rank 1: Ink overflowing was clearly observed even with naked eyes, and color unevenness occurred on the image.

2) Resistance to Roller Marks

A black solid image (image of 100% duty) was recorded on each of the recording media by a platinum mode (default setting) of an ink jet recording apparatus (trade name: PIXUS MP990, manufactured by Canon Inc.). The resistance to roller marks (flows caused by conveying rollers) of the recording medium was evaluated with naked eyes according to the following criteria.

Evaluation Criteria

Rank 4: No flaw was observed under both indoor environment and sunlight;

Rank 3: Flaws were not observed under the indoor environment, but observed under the sunlight;

Rank 2: Flaws were observed even under the indoor environment when viewed from a particular angle;

Rank 1: Flaws were observed even under the indoor environment even when viewed from any angle.

The results are shown in Table 4.

TABLE 4

| | Evaluation results | |
|---|---|---|
| | Ink absorbency Rank | Resistance to roller marks Rank |
| Ex. 1 | 4 | 4 |
| Ex. 2 | 4 | 4 |
| Ex. 3 | 4 | 4 |
| Ex. 4 | 2 | 4 |
| Ex. 5 | 4 | 3 |
| Ex. 6 | 3 | 3 |
| Ex. 7 | 4 | 4 |
| Ex. 8 | 4 | 4 |
| Ex. 9 | 2 | 2 |
| Ex. 10 | 2 | 2 |
| Ex. 11 | 3 | 4 |
| Ex. 12 | 4 | 4 |
| Ex. 13 | 4 | 4 |
| Ex. 14 | 4 | 4 |
| Ex. 15 | 4 | 4 |
| Ex. 16 | 4 | 4 |
| Ex. 17 | 3 | 4 |
| Ex. 18 | 4 | 4 |
| Ex. 10 | 4 | 4 |
| Ex. 20 | 4 | 4 |
| Ex. 21 | 4 | 4 |
| Ex. 22 | 4 | 4 |
| Ex. 23 | 4 | 4 |
| Ex. 24 | 4 | 4 |
| Ex. 25 | 3 | 4 |
| Ex. 26 | 3 | 4 |
| Ex. 27 | 2 | 4 |
| Ex. 28 | 4 | 3 |
| Ex. 29 | 3 | 4 |
| Ex. 30 | 4 | 4 |
| Ex. 31 | 4 | 4 |
| Ex. 32 | 4 | 3 |
| Ex. 33 | 4 | 3 |
| Ex. 34 | 4 | 4 |
| Ex. 35 | 4 | 4 |
| Ex. 36 | 4 | 4 |
| Ex. 37 | 4 | 4 |
| Ex. 38 | 4 | 4 |
| Ex. 39 | 4 | 4 |
| Ex. 40 | 2 | 4 |
| Ex. 41 | 2 | 4 |
| Ex. 42 | 4 | 4 |
| Comp. Ex. 1 | Impossible of evaluation due to occurrence of crack | |
| Comp. Ex. 2 | 1 | 4 |
| Comp. Ex. 3 | 1 | 4 |
| Comp. Ex. 4 | 1 | 4 |
| Comp. Ex. 5 | 1 | 4 |
| Comp. Ex. 6 | 4 | 1 |
| Comp. Ex. 7 | 4 | 1 |
| Comp. Ex. 8 | 4 | 1 |
| Comp. Ex. 9 | 4 | 1 |

As shown in Table 4, the ink jet recording media according to the present invention were excellent in both ink absorbency and resistance to roller marks. On the other hand, in the ink jet recording medium of Comparative Example 1, the amount of the binder in the ink receiving layer was smaller than 12.7% by mass to cause cracks at a stage of production, and so the evaluation could not be made. In the ink jet recording medium of Comparative Example 2, the lower layer did not contain the silica, and so the ink absorbency was poor. In the ink jet recording media of Comparative Examples 3 and 4, the average pore radius of the lower layer is more than 1.30 times larger than that of the upper layer, and so the ink absorbency was poor. In the ink jet recording medium of Comparative Example 5, the layer thickness of the upper layer was smaller than 3.0 μm, and so the ink absorbency was poor. In the ink jet recording media of Comparative Examples 6, 7 and 8, the layer thickness of the lower layer was 2.5 times or less smaller than that of the upper layer, and so the resistance to roller marks was poor. In the ink jet recording medium of Comparative Example 9, the amount of the binder in the whole ink receiving layer was smaller than 12.7% by mass, and so the resistance to roller marks was poor.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-233580, filed Oct. 18, 2010, which is hereby incorporated by reference herein in its entirety.

What is claimed is:

1. An ink jet recording medium comprising a substrate and an ink receiving layer provided on the substrate and composed of two or more layers of at least an upper layer and a lower layer, wherein the ink receiving layer composed of the two or more layers contains polyvinyl alcohol in an amount of 12.7% by mass or more based on the total mass of the ink receiving layer composed of the two or more layers, wherein the upper layer (i) is a layer that is most distant from the substrate in the ink receiving layer composed of the two or more layers, (ii) contains a pigment and polyvinyl alcohol, the pigment containing 90% by mass or more of alumina hydrate, and (iii) has a layer thickness of 3.0 μm or more and 10.0 μm or less, and wherein the lower layer (i) is a layer underneath the upper layer, (ii) contains a pigment and polyvinyl alcohol, the pigment containing 20% by mass or more of silica, and (iii) has a layer thickness 2.5 times or more and 10 times or less larger than that of the upper layer and an average pore radius 0.90 times or more and 1.30 times or less larger than that of the upper layer.

2. The ink jet recording medium according to claim 1, wherein a content of the polyvinyl alcohol in the upper layer is 5.0% by mass or more and 10.0% by mass or less, and a content of the polyvinyl alcohol in the lower layer is 13.0% by mass or more and 20.0% by mass or less.

3. The ink jet recording medium according to claim 1, wherein the upper layer contains a crosslinking agent.

4. The ink jet recording medium according to claim 1, wherein the average pore radius of the lower layer is 1.01 times or more and 1.26 times or less larger than that of the upper layer.

5. The ink jet recording medium according to claim 1, wherein the lower layer contains the silica in an amount of 50% by mass or more based on the total mass of the pigment contained in the lower layer.

6. The ink jet recording medium according to claim 1, wherein the content of the polyvinyl alcohol in the upper layer is 5.0% by mass or more and 10.0% by mass or less, and the content of the polyvinyl alcohol in the lower layer is 13.0% by mass or more and 20.0% by mass or less, wherein the upper layer contains a crosslinking agent, wherein the average pore radius of the lower layer is 1.01 times or more and 1.26 times or less larger than that of the upper layer, and wherein the lower layer contains the silica in an amount of 50% by mass or more based on the total mass of the pigment contained in the lower layer.

7. The ink jet recording medium according to claim 1, wherein the lower layer contains the silica in an amount of 70% by mass or more based on the total mass of the pigment contained in the lower layer.

8. The ink jet recording medium according to claim 1, wherein the layer thickness of the upper layer is 5.0 μm or more and 8.0 μm or less.

9. The ink jet recording medium according to claim 1, wherein the layer thickness of the lower layer is 2.5 times or more and 8.0 times or less larger than that of the upper layer.

10. The ink jet recording medium according to claim 1, wherein the upper layer contains a crosslinking agent in an amount of 0.2 equivalents or more and 1.0 equivalents or less with respect to the polyvinyl alcohol in the upper layer.

11. The ink jet recording medium according to claim 6, wherein the lower layer contains the silica in an amount of 70% by mass or more based on the total mass of the pigment contained in the lower layer, wherein the layer thickness of the upper layer is 5.0 μm or more and 8.0 μm or less, wherein the layer thickness of the lower layer is 2.5 times or more and 8.0 times or less larger than that of the upper layer, and wherein the upper layer contains the crosslinking agent in an amount of 0.2 equivalents or more and 1.0 equivalents or less with respect to the polyvinyl alcohol in the upper layer.

12. The ink jet recording medium according to claim 1, wherein both upper and lower layers contain an alkylsulfonic acid having 1 to 4 carbon atoms.

13. The ink jet recording medium according to claim 1, wherein the average pore radius of the upper layer is 8.00 nm or more and 11.30 nm or less.

14. The ink jet recording medium according to claim 1, wherein the pigment of the lower layer contains silica and alumina hydrate.

15. The ink jet recording medium according to claim 14, wherein the content by mass of the silica of the lower layer is from about 1 to about 19 times more than the content by mass of the alumina hydrate of the lower layer.

16. The ink jet recording medium according to claim 1, wherein the two or more layers contain polyvinyl alcohol in an amount of 20.0% by mass or less based on the total mass of the ink receiving layer composed of the two or more layers.

17. The ink jet recording medium according to claim 1, wherein the lower layer is a layer directly underneath the upper layer.

* * * * *